United States Patent [19]

Freeman

[11] 4,213,020

[45] Jul. 15, 1980

[54] PNEUMATIC OPERATING MECHANISM FOR A CIRCUIT-BREAKER

[75] Inventor: Willie B. Freeman, Irwin, Pa.

[73] Assignee: Westinghouse Electric Corp., Pittsburgh, Pa.

[21] Appl. No.: 845,769

[22] Filed: Oct. 26, 1977

[51] Int. Cl.[2] ..... H01H 35/24

[52] U.S. Cl. ..... 200/81 R; 200/82 B; 200/148 F

[58] Field of Search ..... 200/148 R, 148 A, 148 B, 200/148 C, 148 D, 148 E, 148 F, 148 G, 148 H, 148 J, 148 BV, 82 B, 81 R

[56] References Cited

U.S. PATENT DOCUMENTS 1,901,679 3/1933 Uebermuth ..... 200/148 F

*Primary Examiner*—J. V. Truhe
*Assistant Examiner*—Morris Ginsburg
*Attorney, Agent, or Firm*—L. P. Johns

[57] ABSTRACT

The present invention relates to the utilization of a surge tank in the pneumatic line interconnecting the high-pressure reservoir with the pneumatic control valve controlling the operation of a driving, or operating piston reciprocally operable within a surrounding operating cylinder to operate a circuit-breaker. Preferably, the volume of the surge tank is roughly of the order of the piston-displacement volume traveled by the driving piston in its opening tripping movement of the circuit-breaker, when the mechanism is used to open the circuit-breaker. However, the mechanism may also be used, if desired, to effect closing of the circuit-breaker. Also, preferably, the inlet connection to the surge tank is somewhat restricted in diameter, so as to limit the gas volume exited from the main high-pressure reservoir, yet, however, nevertheless supplying a desirable biasing air pressure to counteract bouncing back, or return movement of the movable circuit-breaker parts at the end of the opening tripping operation of the associated circuit-breaker when the breaker contacts are fully open.

13 Claims, 7 Drawing Figures

FIG. 2.
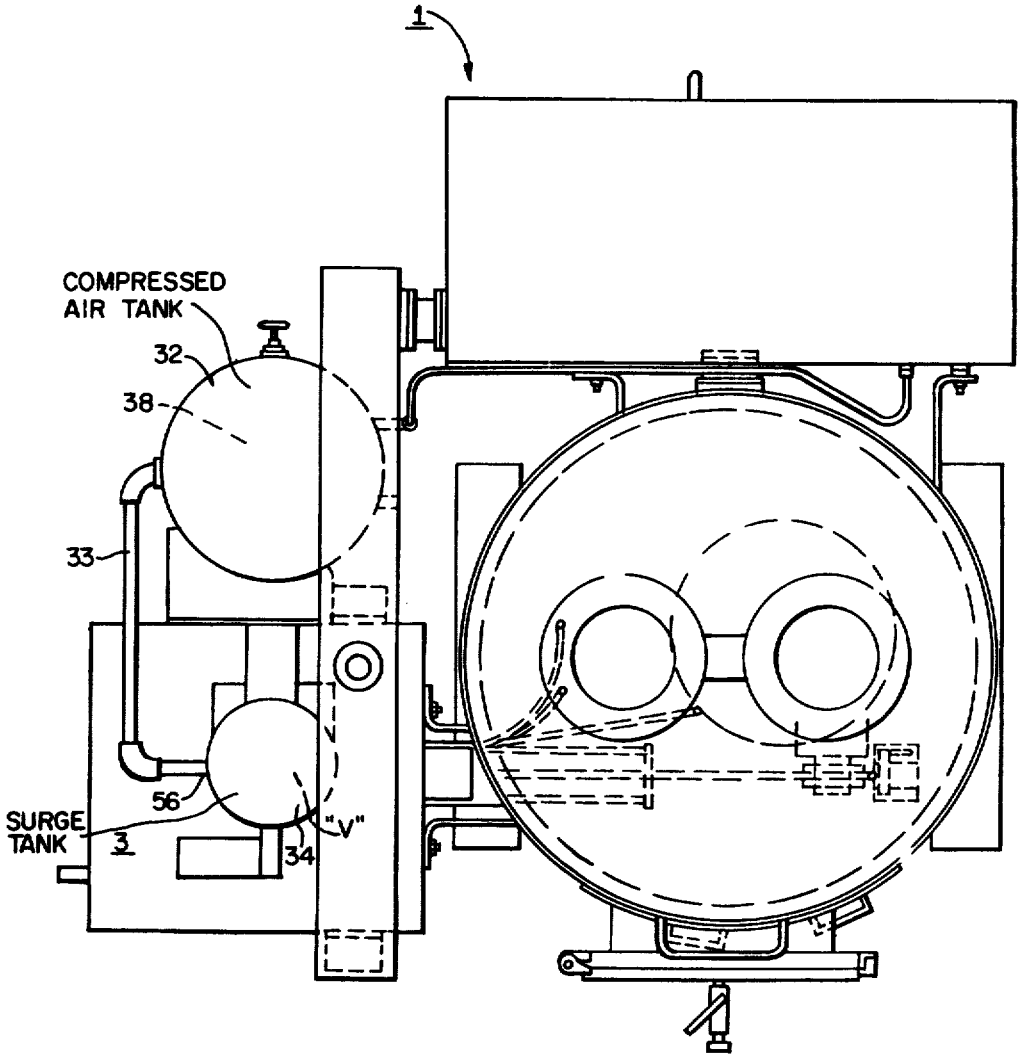
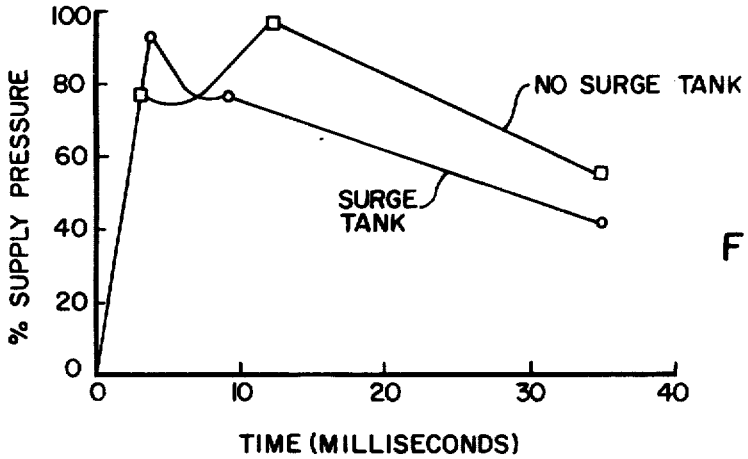
FIG. 7.

PNEUMATIC OPERATING MECHANISM FOR A CIRCUIT-BREAKER

CROSS-REFERENCES TO RELATED APPLICATIONS

Applicant is not aware of any related patent applications pertinent to the particular surge-tank contruction utilized in the present invention, but as far as circuit-breaker background information is concerned, reference may be made to U.S. patent application, filed May 12, 1976, Ser. No. 685,465 by Jeffry R. Meyer et al.; U.S. patent application filed May 12, 1976, Ser. No. 685,466 by Jeffry R. Mayer et al.; and U.S. patent application filed May 16, 1976 Ser. No. 685,826, all of said patent applications being assigned to the assignee of the instant patent application.

BRIEF SUMMARY OF THE INVENTION

In accordance with the present invention, an improved pneumatic operating mechanism is provided for a circuit-breaker, utilizing as a component part thereof, a surge tank interposed in the pneumatic line interconnecting the main high-pressure gas-reservoir chamber with the opening control valve supplying air, or other suitable operating gas under pressure and control, to the main operating cylinder for driving the operating piston, and hence the separable contact structure of the associated circuit-breaker structure to the fully-open tripped position. The mechanism is also adaptable to serve as a high-speed closing mechanism, if desired.

In accordance with one facet of the invention, desirably, the volume "V" of the surge tank approximates the volume "V" displaced by the operating, or driving piston within the operating cylinder as it moves from the circuit-breaker-closed position of the operating piston to the circuit-breaker-open tripped position of the operating, or driving piston.

As an additional feature of the invention, is the use of an inlet pipe, providing high-pressure gas to the inlet side of the surge tank, which is somewhat restricted in diameter roughly providing 5% to 10% flow rate of the valve, so that only a limited quantity of the operating gas will be available for each opening operation of the circuit-breaker, but, nevertheless, there will be an adequate biasing gas-pressure to prevent boucning back, or any retraction of the parts as the movable contact parts, and other component parts of the system, come into engagement at the extreme end of the opening tripping operation.

BRIEF DESCRIPTION OF THE DRAWINGS

FIG. 2 is a top plan view looking downwardly upon the tank structure of FIG. 1, together with the storage tank and operating housing, the view being taken substantially along the line II—II of FIG. 1;

FIG. 7 is a graph showing the comparison between having a surge-tank construction and not having a surge-tank construction, the ordinates being percentage of storage-tank supply pressure, with the abscissae being the time expressed in milliseconds.

DESCRIPTION OF THE PREFERRED EMBODIMENTS

Figure 1:
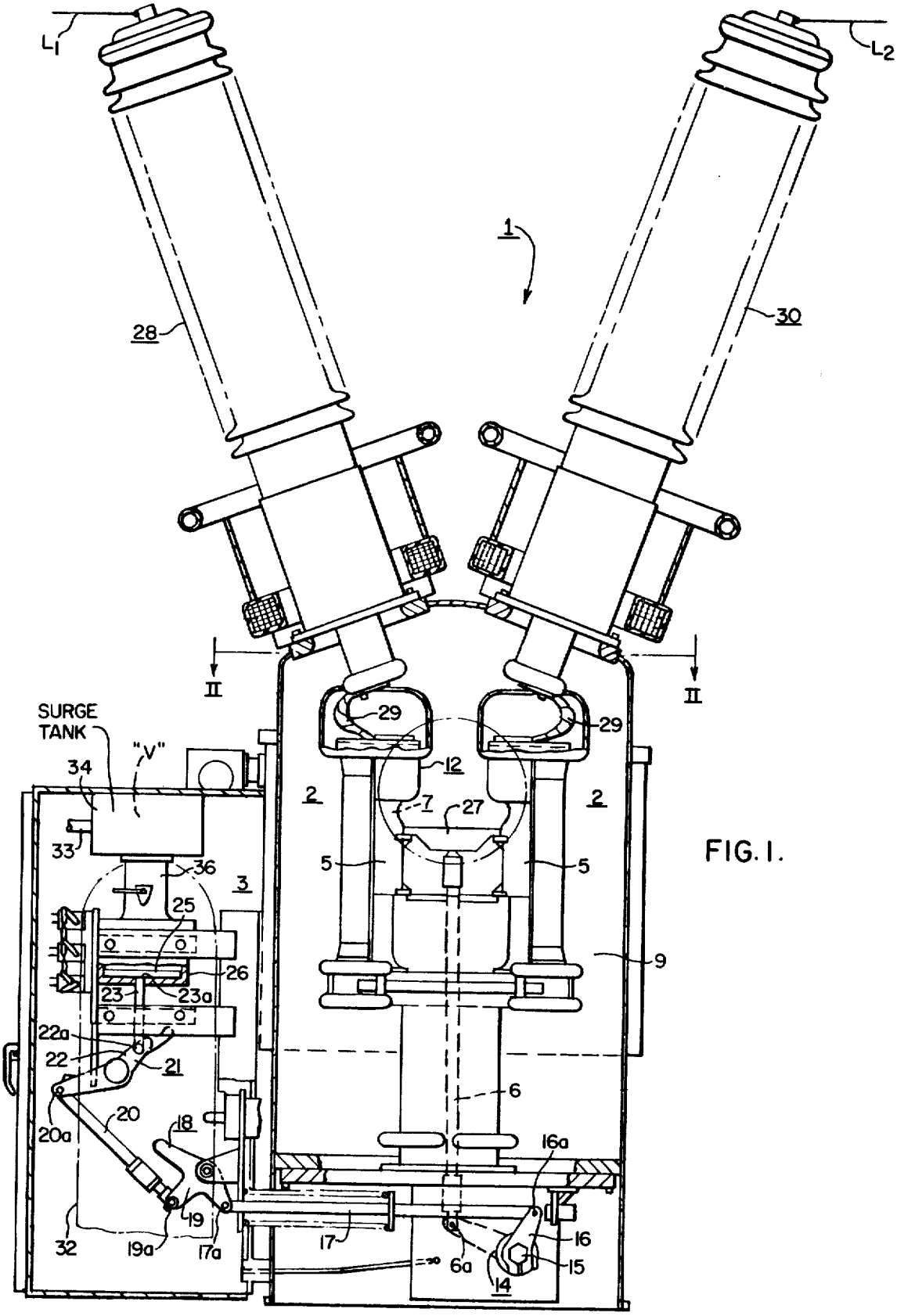
FIG. 1 is a vertical sectional view of a puffer-type compressed-gas circuit-interrupter embodying the principles of the present invention, the contact structure being illustrated in the closed-circuit position.

Referring to the drawings, and more particularly to FIGS. 1 and 2 thereof, the reference numeral 1 generally designates a circuit-breaker of the compressed-gas type. Although the improved pneumatic operating mechanism 3 of the instant disclosure is applicable to any type of circuit-breaker construction, namely an oil type, an air type, a vacuum type, or of a variant different type, nevertheless, for purposes of illustration only, FIGS. 1 and 2 illustrate, for example, a compressed-gas circuit-interrupter 1 of the so-called puffer-type.

Figure 3:
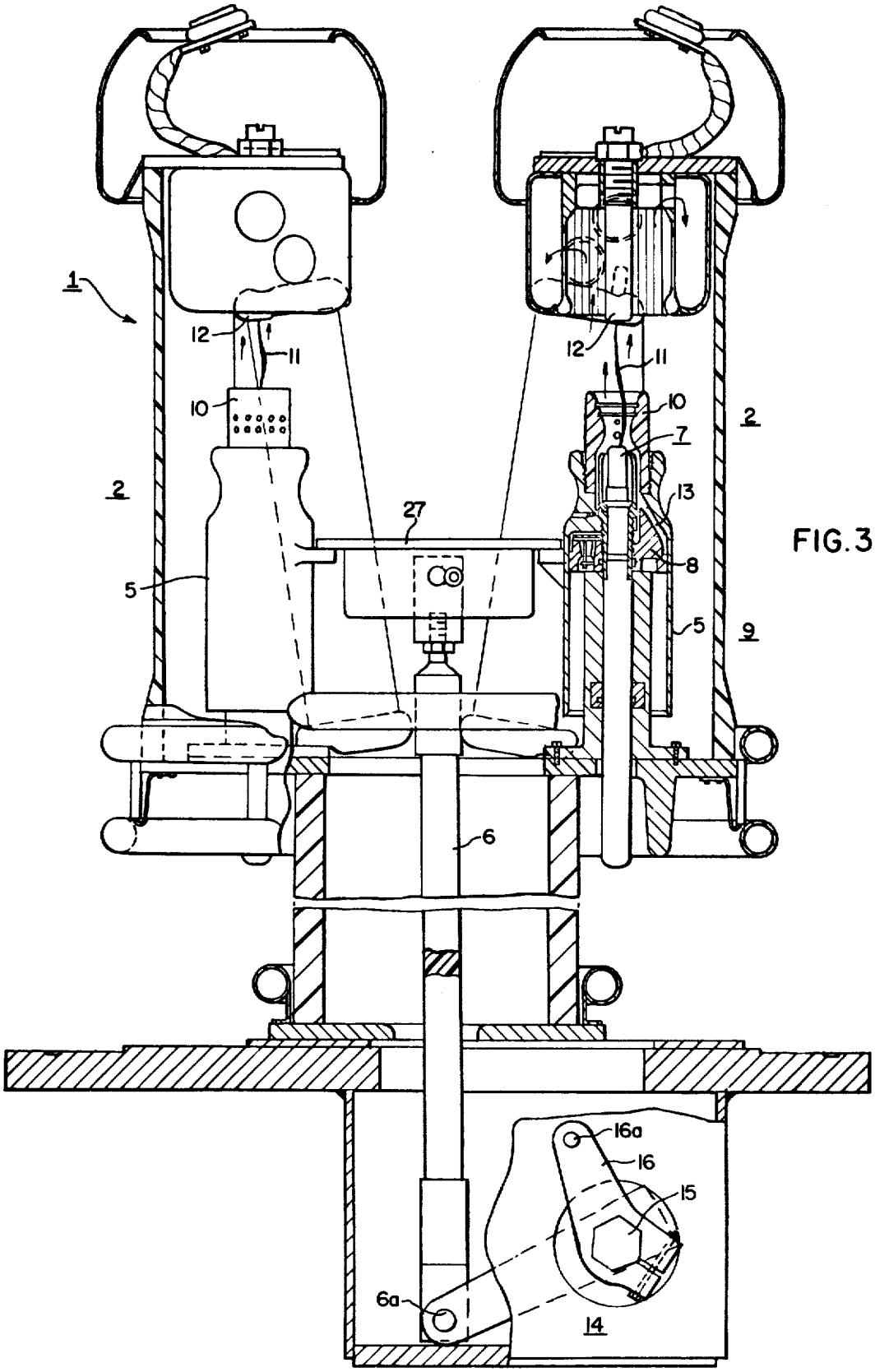
FIG. 3 is a considerably-enlarged vertical sectional view of the two "puffer" units of FIG. 1, the contact structure, however, being illustrated in the fully-open-circuit position.

As well known by those skilled in the art, such a puffer-type circuit-interrupter 1 includes the compressive action of a movable operating cylinder 5, carrying the movable contact structure 7, and slidable over a relatively-stationary fixed piston structure 8 (FIG. 3) and compressing gas 9 therebetween. Such compressed gas 9 is forced through a hollow movable nozzle structure 10 into engagement with the arc 11, as illustrated more fully in FIG. 3 of the drawings.

Applications, which more fully describe, in detail, the operation of such a puffer-type circuit-interrupter, are, typically, U.S. patent application filed May 12, 1976, Ser. No. 685,465 by Jeffry R. Meyer et al., now U.S. Pat. No. 4,095,068, issued June 13, 1978; U.S. patent application filed May 12, 1976, Ser. No. 685,466, by Jeffry R. Meyer at al., now U.S. Pat. No. 4,101,748, issued July 18, 1978; and U.S. patent application filed May 13, 1976, Ser. No. 685,826 filed by Willie B. Freemen et al., all of the aforesaid patent applications being assigned to the assignee of the instant patent application.

Generally, the operation of such a type of puffer circuit-interrupter 1 involves the opening and closing movements of a pair of movable contacts 7 from a pair of cooperable stationary contacts 12, together with the compression of gas 9 between the movable operating cylinder 5 and the cooperating stationary fixed piston structure 8.

As more clearly illustrated in FIGS. 1 and 2, the two puffer units 2 are enclosed within a surrounding gaseous environment, and operated vertically by an insulating operating rod 6, the latter being pivotally connected, as at 6a, to a bell-crank system 14 having an axis of rotation at the rotatable operating shaft 15. An operating lever 16, fixedly connected to the operating shaft 15, is pivotally connected, as at 16a, to a generally-horizontally-extending floating link 17, which is, in turn, pivotally connected, as at 17a, to a second bell-crank system 18, one arm 19 of which is pivotally connected, as at 19a, to a second floating link 20.

The floating link 20 is pivotally connected, as at 20a, to a third bell-crank system 21, having an arm 22 pivotally connected, as at 22a, to an associated piston-rod 23, the upper end 23a of which is fixedly secured to a reciprocally-movable operating, or driving piston 25 reciprocally operable in a vertical direction, for example, within a surrounding stationary operating cylinder 26.

Accordingly, it will be noted that reciprocal vertical opening and closing movements of the operating piston 25 are translated, through the three bell-crank systems 14, 18 and 21 to the vertically-extending insulating operating rod 6, the latter, in turn, effecting upward closing motion of a conducting bridging member 27 carrying the two movable contacts 7, and, conversely downwardly opening, tripping, separating motion of the aforesaid bridging member 27 and the two movable contacts 7. As mentioned, two arcs 11 are drawn, which are extinguished by an upward flowing blast of gas 9 compressed within the compression region 13 disposed between the movable operating cylinder 5 (FIG. 3) and the internally-disposed stationary fixed piston structure 8.

As is well known by those skilled in the art, the electrical circuit passes in an obvious manner from the line connection $L_1$ through a terminal-bushing 28, flexible connector 29, upper left stationary contact structure 12, upper left movable contact structure 7, through a conducting movable horizontal bridging member 27 to the right-hand puffer-unit 2, from whence the electrical circuit extends, in a similar manner, upwardly and through the upper right flexible connector 29 and through the right-hand terminal-bushing 30 to the upper line-connection $L_2$.

The present invention is more particularly concerned with an improved pneumatic operating mechanism 3 for operating the ciruit-interrupter 1, as briefly described above. However, it is to be clearly understood that the improved pneumatic operating mechanism 3, as described hereinafter, is applicable to other, and widely-different types of circuit-breaker structures, namely, for example, an oil-type circuit-breaker, a compressed-air type of circuit-breaker, an air-type circuit-breaker, or a vacuum-type circuit-breaker, etc.

Figure 4:
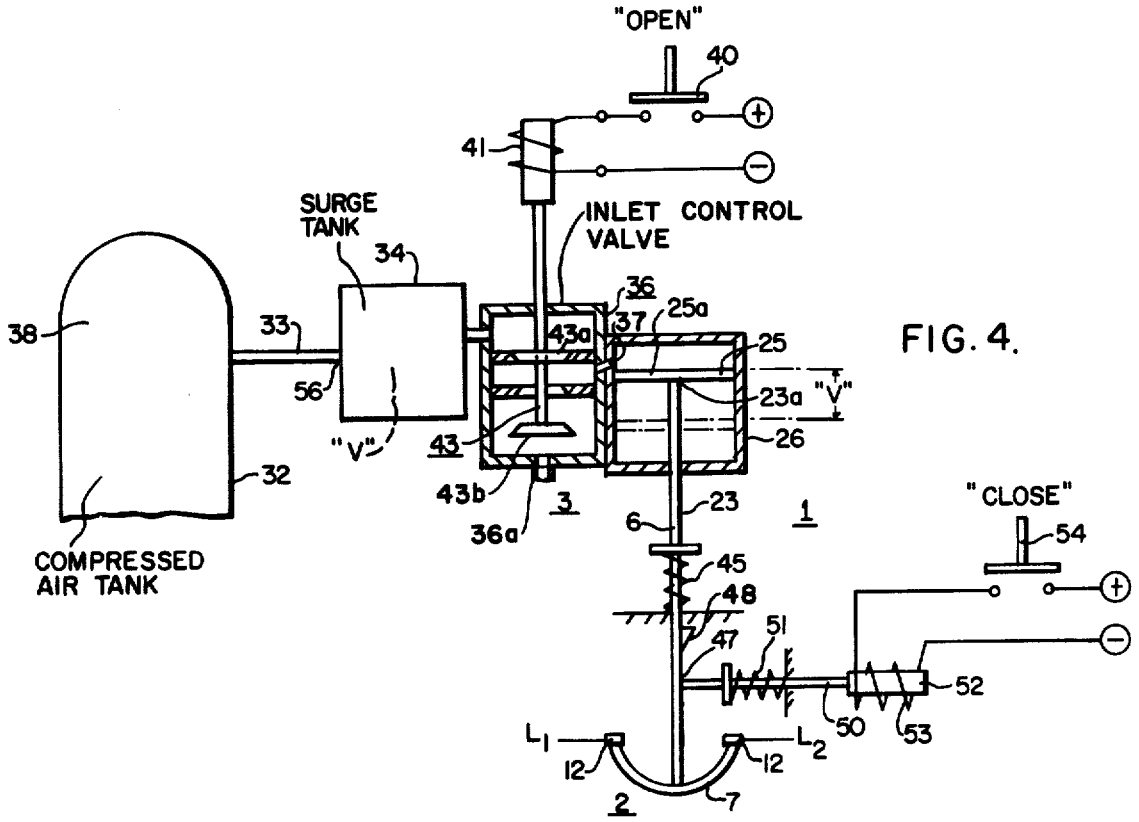
FIG. 4 is a diagrammatic view illustrating the principles of the present invention, the contact structure being illustrated in the closed-circuit position.

With particular reference being directed to FIGS. 1, 2 and 4, it will be observed that there is provided a main high-pressure gas-reservoir tank 32, which has a somewhat restricted pneumatic line-connection 33 to a surge tank 34, the latter being in preferably close pneumatic proximity to an electrically-actuated opening tripping control valve 36, which is capable of controlled introduction through an aperture 37 of a gaseous operating fluid, such as compressed air 38, for example, to the top working, or driving surface 25a of the movable operating piston 25.

Accordingly, energization of the "trip" control button 40 will energize the solenoid 41 thereby raising the control valve structure 43, including spaced valves 43a and 43b, upwardly, thereby cutting off the exhaust pressure above the movable driving piston 25, via an exhaust outlet 36a and introducing through the aperture 37 a high-pressure operating fluid 38 from the surge tank 34.

This will cause downward opening tripping motion of the operating, or driving piston 25 in opposition to closing biasing springs 45, and consequent opening of the horizontal bridging contact member 7 away from the two stationary contacts 12, as diagrammatically illustrated in FIG. 4 of the drawings.

Preferably, a latching arrangement 47 is provided to latch the contacts 7 in the open-circuit position. As diagrammatically illustrated in FIG. 4, a movable latching "nose" 48 is affixed to the movable contact-operating rod 6, which during downward opening tripping motion moves beneath a horizontally-movable latch-rod 50, the latter being biased by a compression spring 51 to a leftward latching position. The latch-rod 50 has an armature 52 affixed to its right-hand end actuated by a solenoid 53, and upon closing a "close" button 54 resulting energization of the solenoid 53 will cause rightward releasing action of the latch-rod 50. The closing springs 45 will then, of course, effect upward closing movement of the separable contact structures 7, 12.

It will be apparent that the pneumatic tripping mechanism 3 is supplied with energy from an adjacent high-pressure air-storage tank, such as the main high-pressure reservoir tank 38. The speed of operation of the circuit-breaker 1, and thereby the interrupting performance and time is dependent upon this compressed-air supply 38. For example, for a particular puffer-type circuit-breaker of the type illustrated in FIG. 1, the circuit-breaker was uprated from 2½ cycles to 2 cycles interrupting time by increasing the air pressure in the tank 38 from 285 p.s.i.g. to 450 p.s.i.g. It has been discovered that improved high-speed contact operation is obtainable by the use of the surge tank 34, which is illustrated in FIGS. 1, 2 and 4. As shown, the surge tank 34 is shown connected directly above the tripping control valve 36.

The surge tank 34 eliminates the 30% pressure drop through the connecting air hose 33, and effectively increases the operating air pressure initially to the operating mechanism 3 for the same storage-tank pressure. The surge tank 34 also limits the air used by the mechanism 3 by reducing the mechanism air pressure at the end of an opening operation. The advantages are higher-speed operation with less end-of-travel shock, and lower-required air pressure with lower air usage.

The surge tank 34 reshapes the air pressure to the mechanism 3, as illustrated in the graph of FIG. 7. As shown in FIG. 7, this increases the initial pressure from, for example, 77% to 94% of the main supply pressure afforded by the main reservoir tank 32. The operating pressure for a commercial-type "puffer" circuit-breaker was reduced from 280 p.s.i.g. to 270 p.s.i.g., and moreover, the air consumption was reduced by about 6 p.s.i.g. per operation.

It is preferable that the surge-tank volume "V" should be about equal to the displacement volume "V" of the mechanism-driving piston 25. A lower volume "V" for the surge tank may allow the circuit-breaker 1 to "stall" during the opening tripping operation. A larger volume "V" is not necessary to obtain higher initial pressures, and will, moreover, cause more wasted air at the end of the opening operation of the circuit-breaker 1. A restriction orifice 56 (FIGS. 4 and 6) to the inlet of the surge tank 34 should, preferably, be sized only large enough to provide sufficient inflowing air at the end of the opening stroke of the circuit-breaker 1 to latch the operating mechanism 3 by the latching device 47.

Figure 5:
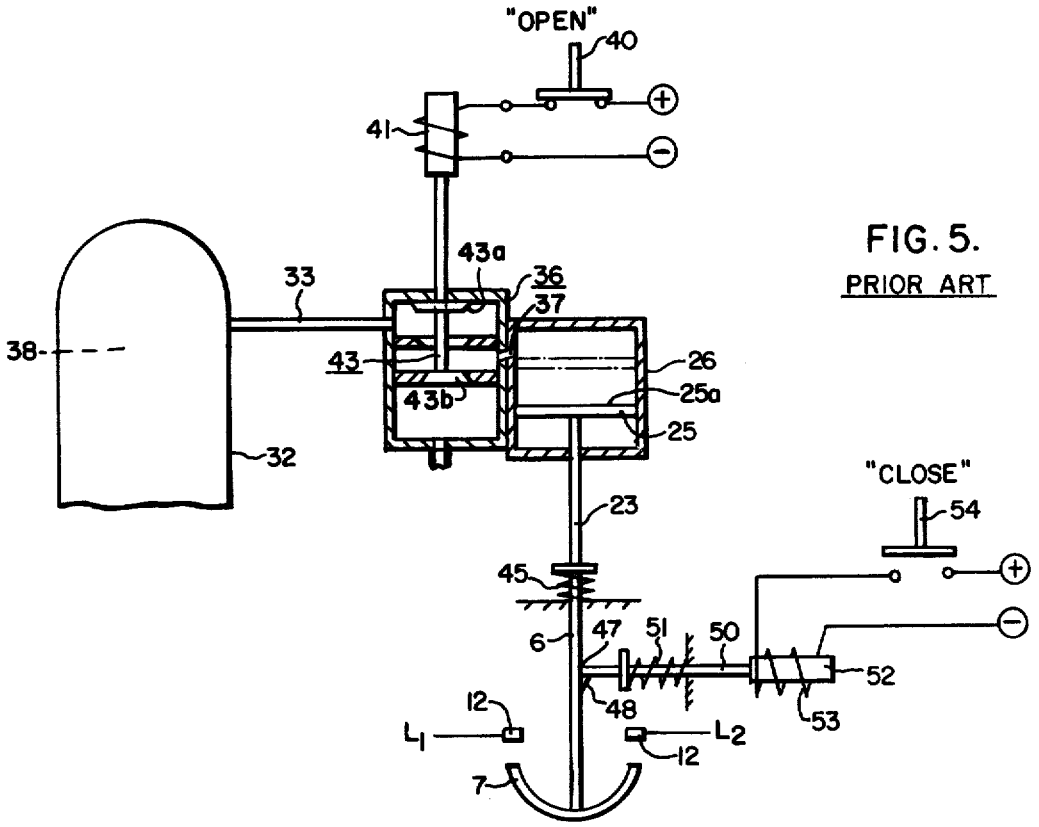
FIG. 5. PRIOR ART
FIG. 5 is a view of a prior-art pneumatic operating mechanism having no surge-tank construction whatever, the contact structure, however, being illustrated in the fully-open-circuit, tripped position.

FIG. 5 shows the prior-art construction in which a surge tank 34 was not employed. Additionally, FIG. 5 illustrates the position of the parts at the end of the opening tripping operation, at which time the circuit-breaker contacts 7, 12 are latched by the tripping device 47 in their open, latched position.

Figure 6:
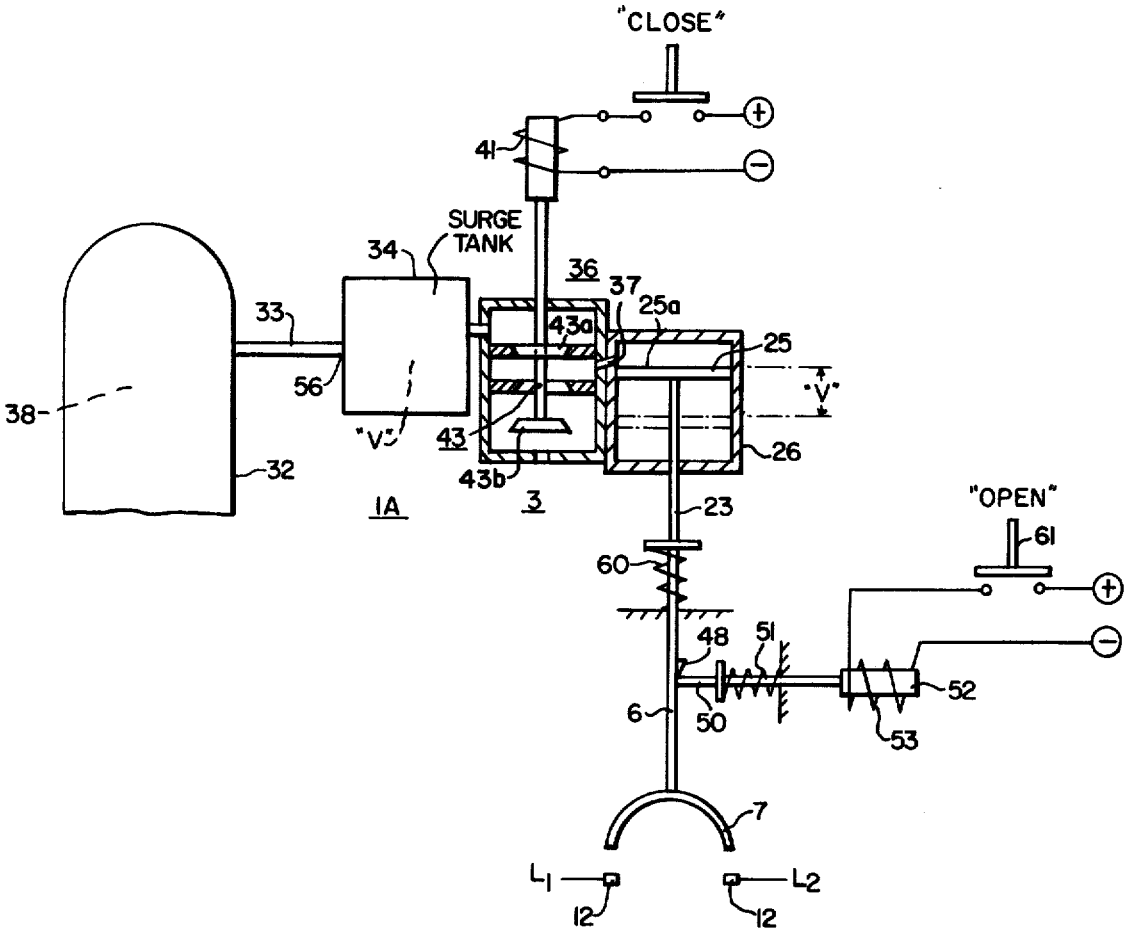
FIG. 6 shows an alternate construction in which the improved pneumatic operating mechanism of the present invention is used to close the breaker instead of effecting its opening operation.

FIG. 6 shows a modified-type of circuit-breaker 1A in which the mechanism 3 is used to close the breaker instead of effecting its opening, as was the case in FIGS. 1–4. The operation of the component parts is as described heretofore and will not be repeated. The spring 60 in this embodiment of the invention is an opening, accelerating spring, and will effect opening of the circuit-breaker 1A upon pressing the "open" button 61.

From the foregoing description of the present invention, it will be apparent that there has been provided an improved pneumatic operating mechanism 3 having the interposition of a surge tank 34, which desirably limits the quantity of compressed gas 38, which is utilized for each opening operation, and, additionally, provides an increased pressure during the initial portion of the opening operation (as illustrated in FIG. 7), and, moreover, provides a desirable biasing action to prevent rebound of the fast-moving operating parts at the end of the open-circuit position.

Although there has been illustrated and described specific structures, it is to be clearly understood that the same were merely for the purpose of illustration, and that changes and modifications may readily be made therein by those skilled in the art, without departing from the spirit and scope of the invention.

What is claimed is:

1. A circuit-interrupter including a pair of cooperable separable contacts, at least one of which is movable, a pneumatic operating mechanism for effecting opening and closing motions of said one movable contact, said pneumatic operating mechanism including a main high-pressure gas-reservoir tank (32) and an inlet control valve (36), a movable driving piston reciprocally operable within a stationary operating cylinder, linkage means interconnecting said movable driving piston to said one movable contact, said inlet control valve controlling the admission of high-pressure operating gas from said main high-pressure gas-reservoir tank (32) to the driving side of the movabe driving piston for effecting the operation thereof, a separate surge tank (34) of appreciable volume interposed in the pneumatic operating mechanism extending between the main high-pressure gas-reservoir tank and the inlet control valve for increasing the initial high-pressure gas supplied to the driving piston, and there being no valve in said mechanism between said tanks, whereby pressure in the surge tank is substantially equal to that in said main tank to effect operation of the piston when the inlet control valve is opened.

2. The circuit-interrupter of claim 1, wherein the volume "V" of the separate surge tank (34) is of approximately the same volume "V" as the displacement volume of the movable driving piston (25).

3. The combination according to claim 1, wherein said mechanism comprises a pneumatic inlet pipe (33) leading to the surge tank (34) and comprises a restriction orifice that provides roughly 5% to 10% flow rate as the gas opening through the inlet control (36).

4. The combination according to claim 3, wherein the size of the restriction orifice is sufficiently large to afford a desirable gas-biasing pressure to prevent thereby rebound of a portion of said mechanism at the end of the opening motion.

5. The combination according to claim 1, wherein the surge tank (34), the inlet-control valve (36) and the stationary operating cylinder (26) are juxtaposed in position.

6. The combination according to claim 1, wherein means are provided to bias the separable contacts to a closed-circuit position, and a latching device (47) is provided to latch the separable contacts open at the end of the opening motion.

7. The combination according to claim 2, wherein a latching device (47) is provided to latch the separable contacts open at the end of the opening motion, and biasing means (45) are provided to bias the contacts to their closed-circuit position.

8. A compressed-gas puffer-type circuit-interrupter of the type involving two interrupting breaks and including an outer grounded metallic tank and a pair of terminal-bushings supported by said grounded metallic tank, a pneumatic operating mechanism (3) including a main gas high-pressure reservoir storage tank (32), an inlet control valve (36) and a driving piston (25) reciprocally operable within a stationary operating cylinder (26), the improvement which comprises the interposition of a surge tank (34) in the pneumatic operating mechanism between the main high-pressure gas-reservoir tank (32) and the inlet control valve (36), there being no valve in said mechanism between said main tank and the surge tank, wherein the volume "V" of the surge tank (34) is approximately the same volume "V" as the driving piston (25) displacement volume.

9. The combination according to claim 8, wherein the surge tank, the inlet control valve and the stationary operating cylinder are in juxtaposed relationship.

10. The combination according to claim 8, wherein biasing means (45) are provided to bias the movable contacts of the two breaks to a closed-circuit position, and latching means (47) are provided to latch separable contacts open at the end of an opening operation.

11. The combination according to claim 8, wherein the surge tank (34) comprises an outlet orifice that is of roughly the same diameter as a gas opening through the inlet-control valve (36).

12. A circuit-interrupter including a pair of cooperable separable contacts, at least one of which is movable, a pneumatic operating closing mechanism for effecting the closing operation of said one movable contact, biasing means for effecting opening of said one movable contact, said pneumatic operating closing mechanism including a main high-pressure gas-reservoir tank (32) and an inlet-control valve (36), a movable driving closing piston reciprocally operable within a stationary operating closing cylinder, linkage means interconnecting said movable driving closing piston to said one movable contact, said inlet control valve controlling admission of high-pressure operating closing gas from said main high-pressure gas-reservoir tank (32) to a closing, driving side of the movable driving closing piston for effecting thereby a closing operation of the circuit-interrupter, a separate surge tank (34) of appreciable volume interposed in the pneumatic operating closing mechanism extending between the main high-pressure gas-reservoir tank (32) and the inlet control valve (36) for increasing an initial high-pressure closing gas supplied to the closing driving piston, and said mechanism having no valve between said reservoir tank and said surge tank.

13. The combination according to claim 12, wherein latching means are provided to latch the circuit-interrupter in a closed-circuit position.

* * * * *